United States Patent [19]

McBride

[11] 4,274,387

[45] Jun. 23, 1981

[54] SLINGSHOT

[76] Inventor: George H. McBride, 7612 Teal Dr., Huntsville, Ala. 35802

[21] Appl. No.: 141,285

[22] Filed: Apr. 18, 1980

[51] Int. Cl.[3] ..... F41B 7/00

[52] U.S. Cl. ..... 124/20 A

[58] Field of Search ..... 124/20 R, 20 A, 49, 124/41 R

[56] References Cited

U.S. PATENT DOCUMENTS

| | | | |
|---|---|---|---|
| 2,661,731 | 12/1953 | Casey | 124/20 A |
| 3,407,798 | 10/1968 | Rock | 124/20 A |
| 3,618,585 | 11/1971 | Allison | 124/20 A |
| 4,133,333 | 11/1979 | Janssen | 124/20 R |

*Primary Examiner*—William R. Browne
*Attorney, Agent, or Firm*—C. A. Phillips

[57] ABSTRACT

A slingshot having a pouch formed of a flexible, elongated strap which is pleated by permanent creases extending inward from each side along orthogonal and diagonally intersecting lines, whereby, by pulling end regions of the strap together, a closure is formed to hold pellets. This closure is operable, and the pellets releasable, in the normal course of shooting by release of the two sides of the strap. Pellets are stored in the handle of the slingshot and are metered by an exiting tubular passageway of a selected dimension and which has a restricted inner opening, whereby a discrete quantity of pellets are captured in the passageway when the handle is inverted and then righted.

3 Claims, 5 Drawing Figures

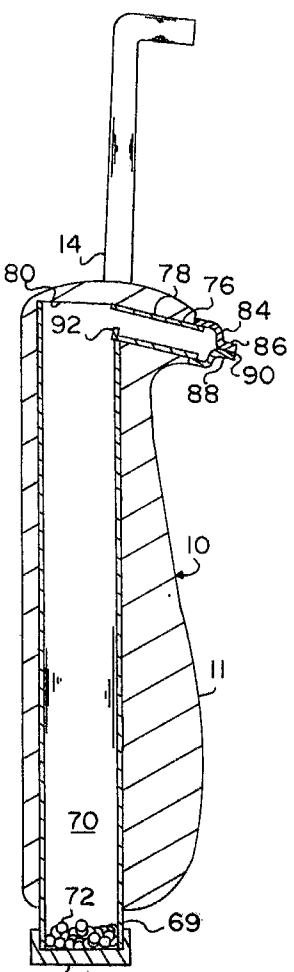
FIG. 3
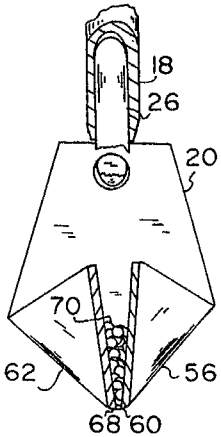
FIG. 2
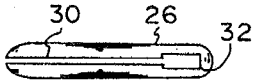
FIG. 5
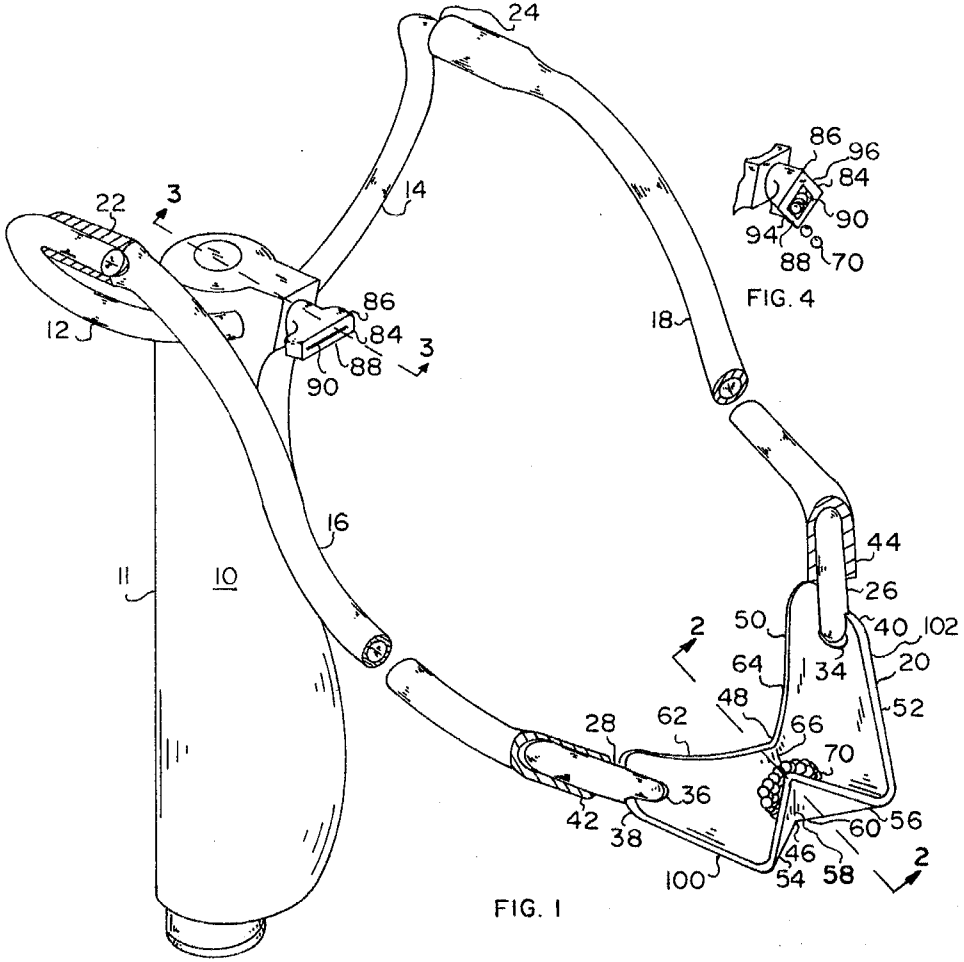
FIG. 1
FIG. 4

SLINGSHOT

TECHNICAL FIELD

This invention relates to slingshots, and particularly to a slingshot equipped with a novel pouch which facilitates the holding and ready release of a shot or shots of pellet-type ammunition.

BACKGROUND ART

It is rather difficult to hold a plurality of pellets or small shot (in contrast to a single slug) in the pouch of a conventional slingshot. This arises because the pouch is typically formed of a flat piece of leather or plastic which is simply folded over double between the thumb and forefinger, which apply a holding pressure to the pellets. Not infrequently, some pellets will fall out. The previous solution to this problem has been to provide some form of mechanically locking pouch, and one such method is illustrated in Allison U.S. Pat. No. 3,618,585. In that patent, the locking mechanism is formed of interlocking strips of velcro. One difficulty with this arrangement is that once the velcro is interlocked, the contents of the pouch are not viewable, and thus one cannot readily see if the pouch is loaded or not, which is not a particularly safe situation. Further, velcro fasteners are relatively expensive and must be held in place by an adhesive or sewed stitches which, after significant use, may release.

A further problem in the employment of slingshots for shooting small shot or pellets is that of the convenient storage, metering the quantity, and leading of these into the pouch of the slingshot. The Allison patent illustrates and describes a storage system, but not a means for loading out a selected quantity of shot. The present invention overcomes the difficulties described above.

DISCLOSURE OF INVENTION

In accordance with this invention, a slingshot pouch is formed from an elongated section of soft leather or leatherlike strap, and the strap has a pair of oppositely positioned, variable depth pleats, wherein each pleat is formed by two symmetrically positioned, diagonally-shaped creases and a crease which extends orthogonally inward from a side edge of the strap on each side of the strap and bisects the diagonal creases. With the strap folded but not folded closed, the pleats partially form a medium depth sloping pocket into which shot, one or more, may be deposited. Afterward, by pressing end regions of the strap completely together between the thumb and forefinger, the pleats are fully formed into an enclosing pocket which quite effectively secures shot in place.

As a further feature of this invention, a hollow handle of a slingshot, employed to store shot, communicates with a tubular passageway which extends through a wall of the handle near one end of it at an angle generally normal to the longitudinal dimension of the handle and in a direction, whereby, by forming the passageway at a slight angle with respect to a line normal to the longitudinal dimension of a handle, and/or by placing a partial closure on the inner end of the passageway, the passageway is filled with shot. Then, by inverting the handle, the shot are trapped. By righting the handle and opening the outer end of the passageway, a selected quantity of shot may be metered into the pouch of the slingshot.

BRIEF DESCRIPTION OF THE DRAWINGS

FIG. 1 is a pictorial view showing an embodiment of the invention.

FIG. 2 is a sectional view along lines 2—2 of FIG. 1.

FIG. 3 is a sectional view along lines 3—3 of FIG. 1.

FIG. 4 is a broken away view illustrating the operation of an openable plug employed in transferring pellets from the handle of the slingshot to the pouch.

FIG. 5 is a side view of a pouch connector.

DETAILED DESCRIPTION OF THE PREFERRED EMBODIMENT

Referring to the drawings, slingshot 10 is basically constructed of a plastic or wooden handle 11 having steel forks 12 and 14 embedded in the handle and extending outward from a top region of the handle. A pair of elastic members 16 and 18 connect between forks 12 and 14 and pouch 20. Elastic members 16 and 18 are typically formed of surgical tubing and are placed over end regions 22 and 24 of forks 12 and 14 and secured by applying a lubricant, such as alcohol or water, to the mating surfaces. The lubricant evaporates, leaving the elastic members affixed to the forks. Pouch 20 is secured to elastic members 16 and 18 by hard plastic connectors 26 and 28, which have an elongated slot 30 terminated in an enlarged slot 32 (FIG. 5). Openings 34 and 36 (FIG. 1) in pouch 20 enable the connectors to be attached to the pouch, whereby extreme end regions 38 and 40 of the pouch rest in slots 30 of the connectors. Ends 42 and 44 of elastic members 16 and 18 are positioned over and attached to connectors 26 and 28 by an adhesive connection.

Pouch 20 is formed of an enlongated piece of soft leather of which pleats 46 and 48 are formed from opposite sides 50 and 52 of the pouch. Pleat 46 is formed by permanent creases 54, 56, and 58, whereby creases 54 and 56 are along generally diagonal lines (with respect to the longitudinal dimension of the pouch) which meet at an inner end of crease 58 at point 60 and at a bisecting angle with respect to the line of crease 58. Similarly, pleat 48 is formed by permanent creases 62, 64, and 66, whereby creases 62 and 64 extend generally diagonally and intersect crease 66 at point 68 and bisect the line of crease 66.

Handle 11 contains a generally elongated tubular magazine 69 for pellets or shot 70. It is closed at a bottom end 72 by an end cap 74, which may either be of a pressure fit or a screw fit (not shown). As a particular feature of this invention, a load or loading chamber 76 is formed by a tubular passageway 78 which extends outward and downward from an upper end region 80 of magazine 69 at an angle of approximately 10° to 15° with respect to a line along the longitudinal dimension of magazine 69. The opposite or outer end 82 of load chamber 76 is closeable by an elastic closure 84 which fits over end 82. Closure 84 is molded to bias sides 86 and 88 together to generally hold closed a slit 90 separating these sides.

To load shot into magazine 69, cap 74 is removed and the magazine loaded. To load shot from magazine 69 into load chamber 76, handle 11 is turned upside down and tilted. Thereafter, shot 70 would be retained in load chamber 76. This is accomplished by virtue of the combination of the angle of load chamber 76 or a protrusion 92. In some instances, sufficient loading of load chamber 76 (depending upon the number and size of shot involved) may be effected simply by the angle of the load chamber without the necessity of protrusion 92.

With load chamber 76 filled, pouch 20 would be positioned just under closure 84 and the sides 94 and 96 of closure 84 pressed together to a configuration shown in FIG. 4, whereby shot would exit though opening 98 and be caught in pouch 20. After being loaded, pouch 20 would be closed by exerting pressure, typically between the thumb and forefinger, on end regions 100 and 102 of pouch 20. Thereby, shot in the pouch would be effectively contained so that regardless of the position of pouch 20, the shot will not fall out. With the shot thus secured and pouch 20 held as described, and with fingers of the other hand holding handle 11, pouch 20 would be pulled back and the slingshot fired in a conventional manner.

By virtue of the unique configuration of pouch 20 with pleats 46 and 48, a simple but effective pocket is formed which securely holds the shot deposited in it, but when released, as in shooting, the pocket readily opens, whereby the shot are propelled between forks 22 and 24. Further, quick and easy inspection of shot in the pouch is effected by simply relaxing pressure on the pouch. A sufficient pocket is retained so that shot will not fall out but can be readily viewed. Since the pouch requires no auxiliary closing or fastening means, it is quite economical to manufacture.

Load chamber 76 provides an extremely simple but effective means of metering a shot load. Where it is desired to vary the quantity of shot loads, different size (different internal diameter and/or length) magazine chambers may be employed. These may be locked in place either by frictional engagement between the chamber and handle or by other conventional locking means.

I claim:

1. A slingshot comprising:

an elongated handle;

a pair of forked prongs extending from and supported by an end of said handle;

a pouch comprising a flexible, pliant, elongated strap;

a first elastic line connected between one of said prongs and one end region of said elongated strap, and a second elastic line connecting between the other of said prongs and an opposite end region of said elongated strap; and said strap having a pair of oppositely positioned, variable depth pleats, one pleat extending inward on each of opposite sides of the strap, and each pleat being formed by two symmetrically positioned, triangular-shaped regions which join along a generally straight common crease which extends orthogonally inward from a side edge of said strap, and by two creases, in an opposite direction to that of said common creases, and in which the line of the two creases extends inward from an outer edge and bisects the line of said common crease, whereby, with said pleats partially formed, a sloping pocket is formed into which shot may be deposited and then the pocket essentially closed by pressing end regions of said strap together to contain the shot and ready the slingshot for shooting.

2. A slingshot as set forth in claim 1 wherein:

said handle is hollow and comprises a reservoir for shot;

a closeable opening in the bottom end of said handle for inserting shot;

a tubular opening in a top region of said handle and extending along a line which is in a plane normal to the plane of said prongs;

a tubular extension of said tubular opening extending into a cavity of said handle and having at its inner termination a lower partial obstruction, whereby, with the handle containing shot, and the bottom end turned up and then turned down, shot will be trapped by said partial obstruction in said tubular extension; and an openable end closure in an outer end of said tubular opening, whereby, with said pouch positioned adjacent to an opened said openable end closure, a metered amount of shot, that contained in the tubular extension, may be deposited into said pouch.

3. A slingshot as set forth in claim 2 wherein said openable closure comprises a plug having an outer end region formed of two sides of elastic material having an edge opening therebetween, but being biased together, whereby, by deforming the biased position of said sides, shot may be released from said tubular opening.

* * * * *